343-756 SR
1/4/77 OR 4,001,836

United States Patent [19]
Archer et al.

[11] 4,001,836
[45] Jan. 4, 1977

[54] PARABOLIC DISH AND METHOD OF CONSTRUCTING SAME

[75] Inventors: John S. Archer, Palos Verdes Peninsula; Harry J. McCracken, Los Angeles, both of Calif.

[73] Assignee: TRW Inc., Redondo Beach, Calif.

[22] Filed: Feb. 28, 1975

[21] Appl. No.: 554,038

[52] U.S. Cl. ..... 343/756; 343/840
[51] Int. Cl.[2] ..... H01Q 19/12
[58] Field of Search ..... 343/756, 840

[56] References Cited

UNITED STATES PATENTS

| | | | |
|---|---|---|---|
| 2,982,961 | 5/1961 | Jones | 343/756 |
| 3,119,109 | 1/1964 | Miller et al. | 343/756 |
| 3,340,535 | 9/1967 | Damonte et al. | 343/756 |

*Primary Examiner*—Eli Lieberman
*Attorney, Agent, or Firm*—Daniel T. Anderson; Donald R. Nyhagen; Jerry A. Dinardo

[57] ABSTRACT

A parabolic dish is constructed by forming from relatively thin flexible sheet material a planar assembly of relatively narrow curved strips arranged side by side and having arcuate longitudinal edges which conform to curves defined by certain parametric equations, such that the strip assembly may be deformed to a parabolic dish configuration wherein the adjacent strip edges are disposed contiguous one another in planes parallel to a plane containing the principle axis of the dish, and joining the strips of the deformed strip assembly to retain the latter in its parabolic dish configuration. A polarizing parabolic dish antenna reflector is constructed by forming on the strips of the planar strip assembly, as by a photoetching process, a plurality of arcuate electrically conductive grid elements conforming to curves established by the parametric equations and bonding the strip assembly in its deformed parabolic dish configuration to a parabolic reflector dish to provide on the parabolic surface of the dish a polarizing grid comprising the grid elements disposed side by side in equally spaced planes parallel to a plane containing the principle axis of the dish.

7 Claims, 11 Drawing Figures

*Fig. 5*

PARABOLIC DISH AND METHOD OF CONSTRUCTING SAME

BACKGROUND OF THE INVENTION

1. Field of the Invention

This invention relates generally to parabolic dish structures and more particularly to a novel segmental parabolic dish and a method of constructing the dish from relatively thin flexible sheet material. The invention relates also to a novel polarizing parabolic dish antenna reflector having a polarizing grid directly on the parabolic surface of the reflector dish and to a method of constructing the reflector utilizing the segmental parabolic dish technique of the invention.

2. Prior Art

In the context of the present invention, a parabolic dish is essentially a relatively thin-walled shell-like structure having the shape of a paraboloid. The dish may be either symmetrical or non-symmetrical about its principle axis. Such a parabolic dish may be utilized for a variety of purposes, and, in its broader aspects, this invention is concerned with providing a segmental parabolic dish which may be used for any of these purposes. In its more limited aspects, however, the invention is concerned with parabolic dish-type antenna reflectors and will be described in connection with this particular application.

A parabolic dish antenna comprises, essentially, a parabolic reflector dish and an antenna feed at the focal point of the reflector. The prior art is replete with a vast assortment of such antennas and reflector dishes and techniques for their fabrication. In some cases, the reflector dish is collapsible for storage in minimum space and in other cases is a rigid structure. This invention is concerned with such antenna reflectors.

One method of forming such a parabolic reflector dish involves forming from sheet material, such as fiber glass cloth, a plurality of sections or gores which may be assembled to form a parabolic reflector dish. These dish sections, or gores, may have various gore shapes such as triangular and circular. This method of reflector dish fabrication is quite satisfactory for many parabolic antenna applications but is not suitable to the particular parabolic antenna application with which the present invention, in its more limited aspects, is concerned.

Thus, these more limited aspects of the invention are concerned with a so-called polarizing or polarized parabolic dish antenna for producing a radiation beam which is polarized in a given direction or plane. This type of antenna is useful on a communications satellite, for example, for the reason that two antennas, with different directions of polarization, may be utilized to beam transmission of the same carrier frequency to two contiguous regions of the earth without interference between the two transmissions, thus effectively doubling the communications capacity of the satellite.

One method of accomplishing such antenna polarization involves mounting of a polarizing grid, consisting of spaced parallel conductors, in front of the antenna reflector dish. This type of polarizing antenna has certain disadvantages which restrict its use. Perhaps one of the foremost disadvantages resides in the fact that outboard placement of the polarizing grid in front of the reflector dish introduces undesirable constraints into the relative positioning of two differently polarized antennas which may preclude placement of the two antennas in the most favorable relative positions. Moreover, this polarizing grid arrangement requires a grid support which increases the antenna weight and complexity and introduces an additional unreliability factor which must be considered.

SUMMARY OF THE INVENTION

One of the more limited aspects of the present invention is concerned with a polarizing parabolic dish antenna reflector which avoids the above-noted and other disadvantages of the prior polarizing parabolic dish antenna. In the polarizing antenna reflector of the invention, the polarizing grid is disposed directly on the parabolic surface of a parabolic reflector dish. This grid comprises a multiplicity of electrically conductive grid elements which extend across the reflector surface in equally spaced planes parallel to one another, and to a plane containing the principle axis of the reflector dish.

This location or placement of the grid elements directly on the surface of the reflector poses a unique problem which is solved by a somewhat broader aspect of the invention involving the formation of a parabolic dish from relatively thin flexible sheet material. In this regard, it will be evident to those versed in the art that placement of the polarizing grid on the reflector surface may conceivably be accomplished in a variety of ways. For example, it would be possible to form the grid by laying wires or narrow metallic strips across the reflector surface and bonding the wires or strips to the surface to form the grid elements. This method of forming the grid, however, would be quite costly and time consuming and would present a severe problem of obtaining the high degree of precision of grid element placement and spacing necessary for optimum antenna operation.

According to the present invention, formation of the polarizing grid is accomplished with a high degree of precision and yet with relative economy utilizing a photoetching process to form the conductive grid elements. This utilization of a photoetching process to form the grid elements, however, presents a further problem which the invention overcomes. This latter problem resides in the fact that it is impossible with existing photoetching equipment to photoetch the grid elements directly on the parabolic surface of a parabolic reflector dish. According to the present invention, this latter obstacle is overcome or avoided by photoetching the grid elements on a planar segmental parabolic dish development of novel configuration such that the photoetched development may be formed into a segmental parabolic dish configuration conforming to the parabolic reflector and having the photoetched grid elements arranged side by side in planes parallel to one another and to a plane containing the principle axis of the dish. This segmental parabolic dish is bonded to the reflector dish to form the completed polarizing parabolic dish antenna reflector, wherein the photoetched grid elements provide a polarizing grid on the surface of the reflector dish.

In this regard, it is significant to note that the prior art parabolic dish development shapes, such as those comprising triangular and circular gores, are not suitable for the purposes of the invention for the reason that the parting lines or edges of the gores, when in their parabolic dish configuration, would intersect and thus create electrical discontinuities in the polarizing grid elements. A unique feature of the segmental parabolic dish development of the present invention resides in the fact that it is composed of an assembly of curved strip-like segments, hereinafter referred to simply as strips, which are uniquely shaped in accordance with certain novel parametric equations, such that when the development or strip assembly is formed to its parabolic dish configuration for bonding to the parabolic reflector dish, the edges of the strips are arranged in planes parallel to the polarizing grid element planes and hence do not intersect and create electrical discontinuities in the grid elements.

It should be noted here that while the novel parabolic dish development is particularly suited for use in the described polarizing parabolic dish antenna application, it may be utilized to form a parabolic dish configuration for other purposes.

DESCRIPTION OF THE PREFERRED EMBODIMENTS

Figure 1:
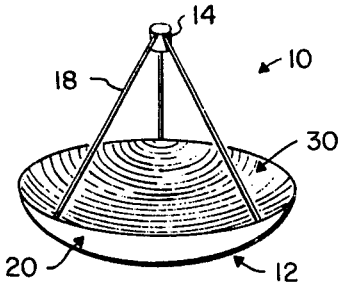
FIG. 1 is a perspective view of a polarizing parabolic dish antenna embodying the invention.
Figure 2:
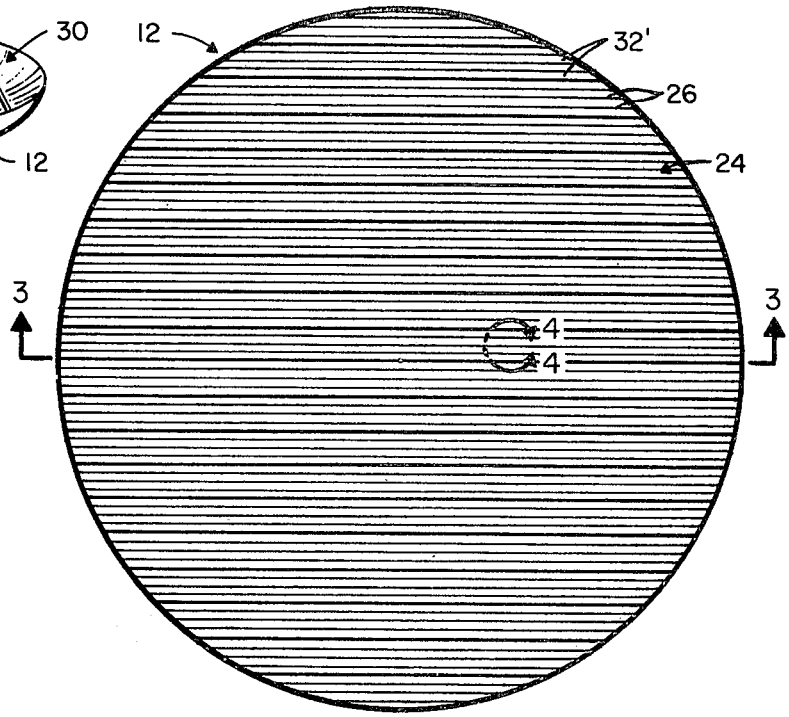
FIG. 2 is an enlarged front view of the antenna reflector.
Figure 3:
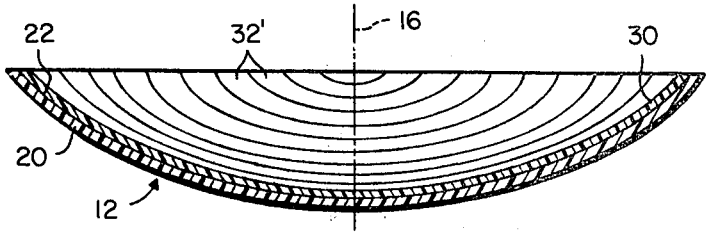
FIG. 3 is a section taken in line 3—3 in FIG. 2.
Figure 4:
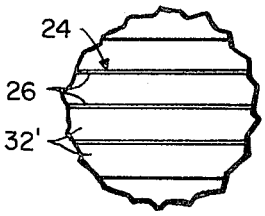
FIG. 4 is an enlargement of the area encircled by the arrow 4—4 in FIG. 2.

Turning first to FIGS. 1 through 4 of the drawings, the illustrated polarizing parabolic dish antenna 10 comprises a parabolic reflector 12 and an antenna feed 14 mounted in front of the reflector, on its principle axis 16, by means of supporting struts 18. Antenna reflector 12 has a rigid parabolic dish 20 which may be fabricated in any conventional way from any suitable material and may comprise, for example, a molded graphite epoxy dish. Directly on the front parabolic face 22 of the dish, and effectively conforming to the curvature of the face, is an electrically conductive polarizing grid 24 composed of a multiplicity of grid elements 26. These grid elements comprise slender conductors which extend across the dish face 22 in planes parallel to one another and to a plane containing the principle axis 16 of the dish 20.

The purpose and operating principle of the polarizating grid 24 is well understood by those skilled in the antenna art and hence need not be elaborated on in this disclosure. Suffice it to say that the polarizing grid polarizes the radiation beam transmitted from the antenna in a manner which permits transmission from two adjacent antennas with mutually perpendicular directions of polarization on the same carrier frequency without interference between the two transmissions.

One important aspect of the invention is concerned with a novel method of providing the polarizing grid 24 on the face 22 of the reflector dish 20. Simply stated, this method involves photoetching the conductive grid elements 26 on a uniquely shaped planar development 28 (FIG. 5) of a segmental parabolic dish or shell constructed from relatively thin flexible sheet material which is electrically non-conductive and transparent to the antenna radiations, folding the photoetched development to its segmental parabolic shell configuration 30 (FIG. 6), and bonding the parabolically folded shell to the face 22 of the reflector dish 20, such that the shell effectively forms a polarizing grid liner on the reflector dish face. This method of the invention will now be described by reference to FIGS. 5 through 11.

Figure 5:
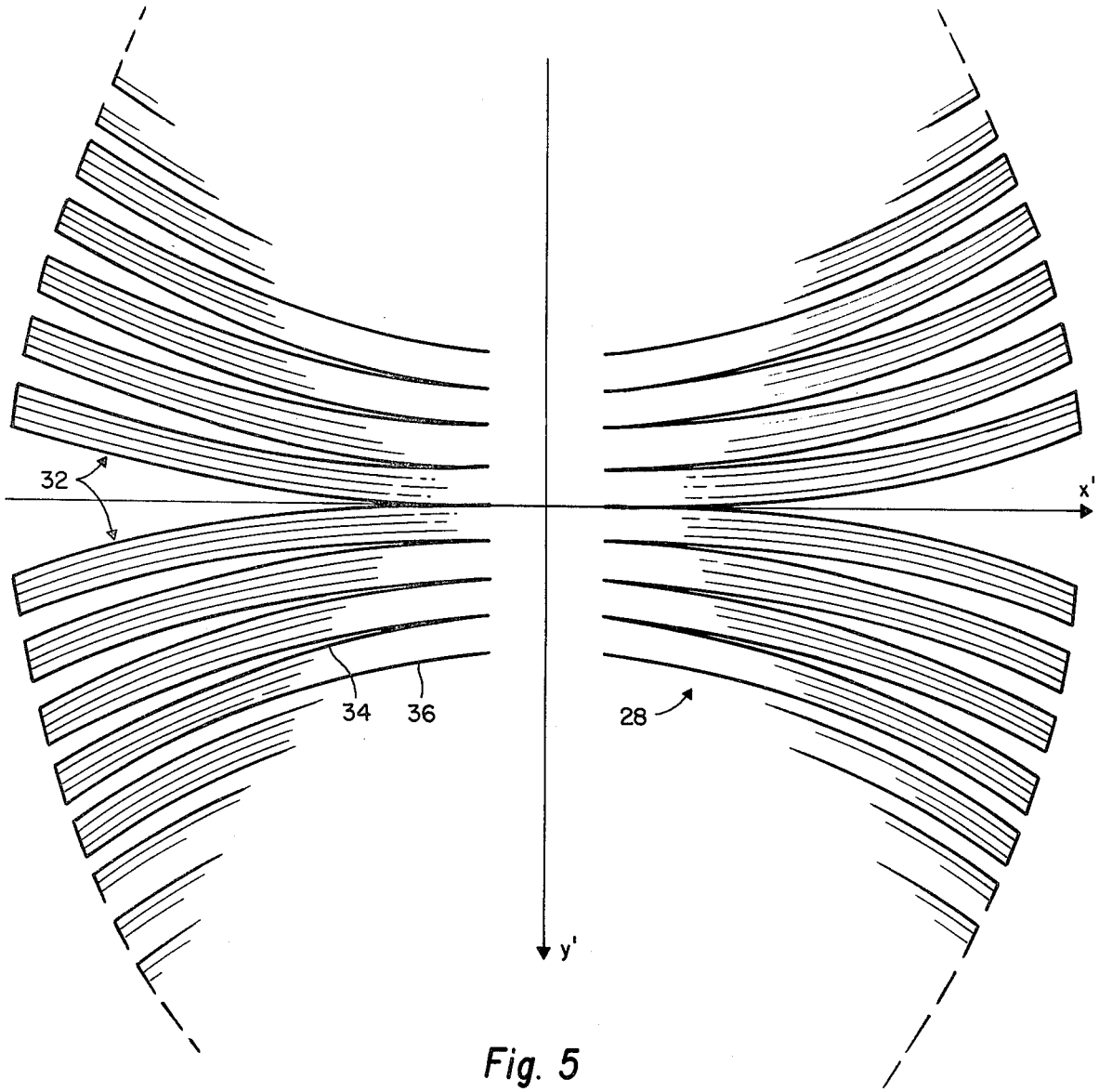
FIG. 5 is a fragmentary planar development from which is formed a parabolic polarizing grid liner embodied in the antenna reflector of FIG. 2.
Figure 6:
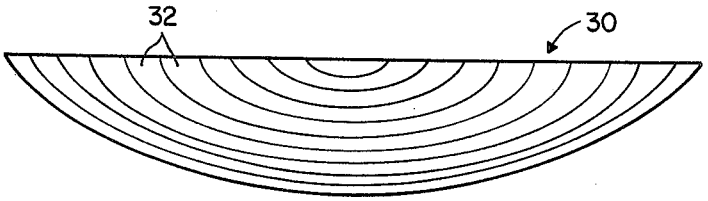
FIG. 6 is a side elevation of the grid liner in its parabolic configuration.

Referring first to FIG. 5, the parabolic grid liner development 28 is fabricated from a relatively thin flexible sheet material, such as fiber glass, and comprises essentially an assembly of curved strips 32 arranged side by side, and joined to one another, as shown, to form an integral strip assembly. The strips 32 are uniquely curved in accordance with the parametric equations developed and set forth below, such that the strip assembly may be formed or folded to the segmental parabolic liner configuration 30 of FIG. 6. This liner comprises a multiplicity of segments 32', formed by the strips 32, whose curved edges 34 and 36 are disposed in contiguous relation to one another and extend across the dish in equally spaced planes parallel to one another and to a plane containing the principle axis of the liner. The grid elements 26 are photoetched on the strips, as shown, and conform substantially to the curvature of their respective strips, such that when the strip assembly 28 is formed or folded to its parabolic liner configuration 30, the grid elements extend across the liner in equally spaced planes parallel to the planes of the segment edges 34 and 36 of the liner. Accordingly, these edges do not intersect the grid elements and hence do not create electrical discontinuities in the grid elements.

The parametric equations defining the curvatures of the strips 32 of the planar parabolic liner development or strip assembly 28, whereby the latter is foldable to its parabolic liner configuration 30 will now be derived by reference to FIGS. 7 through 11. An initial consideration in this derivation involves the width of the strips. In this regard, it will become evident as the description proceeds that the narrower the strips, the closer will the grid liner 30 conform to a true parabolic shape and hence to the parabolic face 22 of the reflector dish 20. Conversely, increasing the strip width reduces the conformity of the grid liner to the parabolic reflector dish face. It has been determined that a relatively high degree of conformity of the liner to the reflector dish is attained with a maximum strip width on the order of ten percent of reflector dish focal length.

The relative widths of the strips 32 must also be considered. In the particular antenna application illustrated, the strips are sized in width such that in the completed antenna reflector 12, all of the strips or segments 32' of the parabolic polarizing grid liner 30 have the same apparent width when viewed parallel to the principle axis 16 of the reflector. Stated in another way, it is evident that the projection of the segments 32' of the grid liner 30 onto a plane normal to the principle axis 16 is a plane figure similar to FIG. 2 conforming in outline to the projection onto the plane of the liner perimeter and divided into equal width increments defined by the projections of the segments, respectively.

Figure 7:
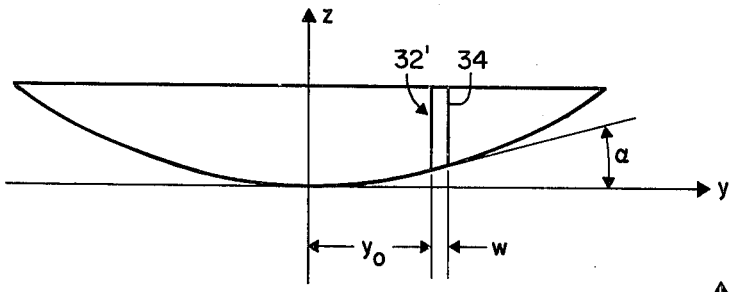
FIGS. 7 through 11 depict the method of the invention for defining the planar grid liner development of FIG. 5.
Figure 8:
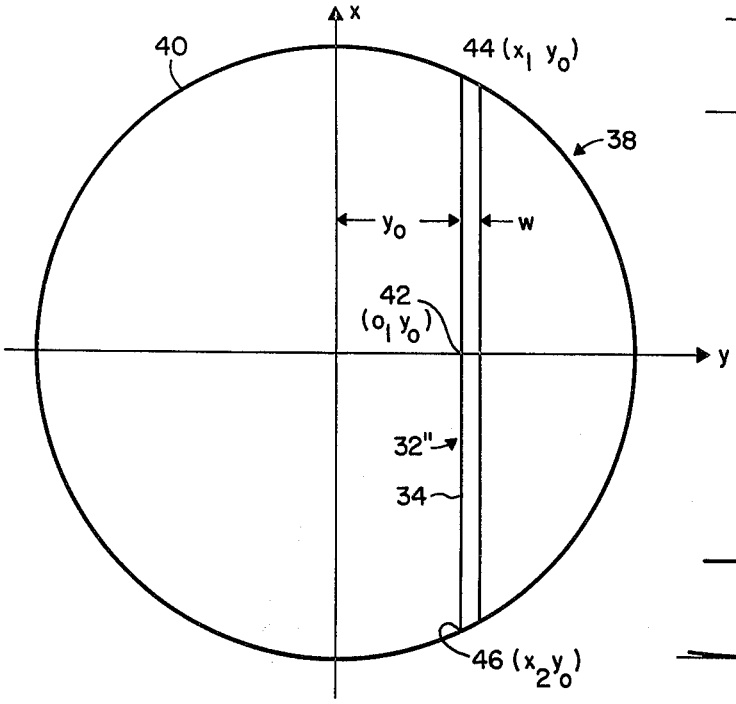

Proceeding now with the actual derivation of the parametric equations referred to above, reference is made first to FIGS. 7 and 8. FIG. 7 illustrates, in semi-diagrammatic fashion with reference to an $x$, $y$, and $z$ coordinate system, a section through the polarizing grid liner 30 in a plane containing the $z$-axis (the principle axis 16 of the liner) and the $y$-axis and shows but one of the liner segments 32'. FIG. 8 is a view looking at FIG. 7 along the $z$-axis and shows, effectively, a plane figure 38 conforming to the projection of the liner and segment of FIG. 7 onto the $x$ and $y$ plane. This plane figure has a perimeter 40 defined by the projected perimeter of the liner and a narrow increment 32'' of width $w$ defined by the projected segment 32' of the liner. The segment edge 34 adjacent the $x$-axis is spaced a distance $y_o$ from the latter axis, whereby the projected edge in FIG. 8 intersects the $y$-axis at an axis intersection point 42 having $x$ and $y$ coordinates $o$ and $y_o$. The edge 34 terminates at the perimeter of the liner 30 in end points 44 and 46 on the perimeter whose coordinates, in the $x$ and $y$ plane of FIG. $i$, are $x_1$ and $y_o$ and $x_2$ and $y_o$. The slope of the segment 32' in the direction of the $y$-axis is constant along the field length of the segment between its end points 44 and 46 and is defined by:

$$\frac{dz}{du} = \frac{y_o}{2F} = \tan \alpha$$

where F is the focal length of the paraboloid to which the liner 30 conforms and which paraboloid is defined by the equation $$z = \frac{1}{4F}(x^2 + y^2).$$

It is evident that the above discussion relative to the liner segment 32' shown in FIG. 7 applies with equal force to all of the liner segments, all of which will have a projected width $w$ in the $x$ and $y$ plane and differ only in the values of their coordinates $x_1$, $x_2$, $y_o$, and their slope $dz/dy$.

Figure 9:
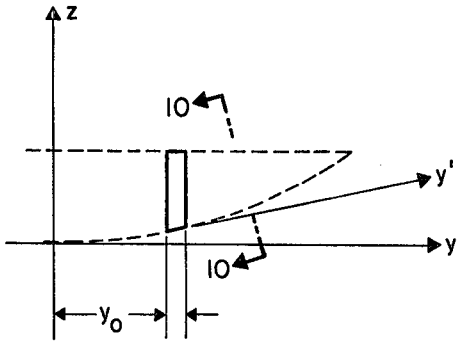
Figure 10:
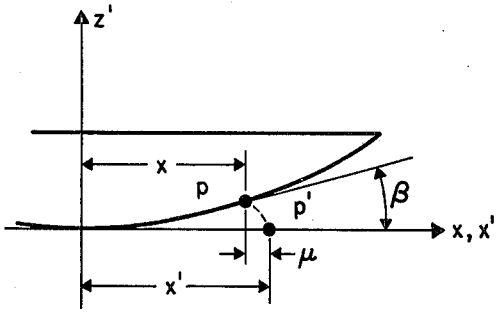

Reference is now made to FIG. 9 which is identical to FIG. 7 except that FIG. 9 contains an additional $x'$, $y'$, and $z'$ coordinate system whose origin is located at the intersection of the edge 34 of segment 32' with the $x$ and $y$ plane and whose $y'$-axis has the same slope $y_o/2F$ as the segment. FIG. 10 is a view of the segment 32' looking along the $y'$-axis, i.e. a view of the segment taken on line 10—10 in FIG. 9. As noted above, the slope of the segment 32' is constant along the full length of the segment, that is the slope is independent of $x$ and $x'$. Accordingly, the segment 32' can be developed into the $x'$ and $y'$ plane.

Consider first the development of the segment edge 34 and specifically any point P (FIG. 10) along this edge, located a distance $x$ from the common $y$, $z$-$y'$ and $z'$ plane. As shown in FIG. 10, this point folds or developes onto the $x'$ and $y'$ plane at the distance $x' = x + u$ from the $y'$ and $z'$ plane, where $$x' = x + u = \int_{x_1}^{x_2} \frac{dx}{\cos \beta}$$

where $\beta$ is the angle between the $x'$ and $y'$ plane and a tangent to the edge 34 at the point P.

Equation (2) above can be reduced as follows:

$$x' = x + u = \int_{o}^{x} \frac{dx}{\cos \beta}$$

$$= x + \frac{1}{2}\left(\frac{\cos \alpha}{2F}\right)^2 \frac{x^3}{3} - \frac{1}{8}\left(\frac{\cos \alpha}{2F}\right)^4 \frac{x^5}{5} +$$

$$= x + \frac{1/24F^2}{\left[1 + \left(\frac{y_o}{2F}\right)^2\right]} x^3 - \frac{1/640F^4}{\left[1 + \left(\frac{y_o}{2F}\right)^2\right]^2} x^5 + \qquad (3)$$

The $y'$ coordinate of the developed point P' in the $x'$ and $y'$ plane is $$y' = x' \sin \alpha = \frac{\sin \alpha \cos \alpha}{4F} x$$

$$= \frac{y_o/8F^2}{\left[1 + \left(\frac{y_o}{2F}\right)^2\right]} \cdot x^2 \qquad (4)$$

where $x$ may be any $x$ coordinate value along the segment edge 34 in FIG. 7 between and including its end points 44 and 46, i.e. any coordinate values between and including $x_1$ and $x_2$.

The above parametric equations (3) and (4) thus define the development of the segment edge 34 onto the $x'$ and $y'$ plane. The developed edge 34 in the $x'$ and $y'$ plane is shown at 34' in FIG. 11.

The developed width $w'$ (FIG. 11) of the segment 32' in the $x'$ and $y'$ plane, parallel to the $y'$-axis is defined by the equation:

$$w' = \frac{w}{\cos \alpha} = \sqrt{1 + \left(\frac{y_o}{2F}\right)^2}\, w \qquad (5)$$

Thus, the above parametric equations (3), (4), and (5) define the planar development of the polarizing grid liner segment 32' shown in FIG. 7 in terms of the desired liner focal length F, the spacing $y_o$ between the segment edge 34 and the $x$ and $z$ plane, and the coordinates $x_1$ and $y_2$ of the end points 44 and 46 of this edge. Accordingly, this planar development of the strip may be formed on sheet material, after which the developed strip may be folded to its parabolic configuration. In view of what has been said to this point, it is clear that the same procedure may be followed to obtain the planar developments of all the segments 32' of the polarizing grid liner 30.

According to the present invention, the above procedure is followed to obtain the polarizing grid liner strip assembly 28 of FIG. 5. Thus, each curved strip 32 of this assembly is the planar development of its corresponding segment 32' of the grid liner 32 formed from relatively thin flexible sheet material, such as fiber glass. The several strips are arranged side by side with their $x'$ and $z'$ plane intersection lines aligned to form the strip assembly which may then be folded to its parabolic configuration and bonded to the antenna reflector dish 20 to form the grid liner 30, as explained earlier. It is evident from the description that when the strip assembly is thus folded, the strip edges 34 and 36 align themselves in contiguous relation in planes parallel to one another and to a plane, i.e. the $y$ and $z$ plane, containing the principle axis 16 of the reflector dish.

The manner in which the planar developments of the liner segments 32' are formed on sheet material to form the strips 32 will be explained presently. Suffice it to say here that the strips could be formed individually and then laid side by side as in FIG. 5 and then joined to form a strip assembly which is then placed on the reflector dish. According to the preferred practice of the invention, however, the developments of all the liner segments are formed on the same piece of sheet material which is then cut along the development edges in the manner shown in FIG. 11 so as to leave the adjacent developments or strips joined adjacent their $y'$ and $z'$ plane intersection lines, thus providing the integral strip assembly 28 which may be folded to its parabolic configuration and bonded to the reflector dish 20, as described.

As mentioned earlier, each of the strips 32/segments 32' contain a multiplicity of the conductive grid elements 26 which extend along the strips/segments generally parallel to their convex edges 34. The manner in which these grid elements are formed on the strips will be explained presently. Suffice it to say here that they conform substantially to developed curves defined by the same parametric equations (3) and (4) as the convex strip edges, such that in the finished polarizing grid liner 30, these grid elements are arranged in planes parallel to the planes of the segment edges 34 and 36. In actual practice, all of the grid elements on each strip may conform to the same developed curve, based on the $x_1$, $x_2$, and $y_o$ coordinates of a selected grid element, such as the center element in the strip. Alternatively, the several grid elements on each strip may conform to the same developed curve as the convex edge of the strip. It will be understood, of course, that the parametric equations (3) and (4) could be utilized to derive the precise developed curve for each and every grid element.

It will now be understood that the strip assembly 28 of FIG. 5 and the grid elements 26 on the assembly strips 32 may be formed on sheet material in various ways. According to the preferred practice of the invention, however, this is accomplished by a photoetching process applying, in any convenient way, a thin layer of copper or other metal to a piece of sheet material, such as fiber glass; coating this layer with a photoresist; projecting onto the sheet material when in a flat condition an image of the strip assembly and grid elements; developing the exposed photoresist to form the boundary lines of the strip and the grid elements; and then cutting the sheet material along the strip boundary lines as explained above.

From the foregoing description, it will be understood that the method of the invention effectively involves determining the $y_o$ coordinate, end point coordinates $x_1$ and $x_2$ and width dimension $w$ of each segment of the finished polarizing grid liner; forming an assembly of curved strips with conductive grid elements conforming to the parametric equations (3), (4), and (5) utilizing the above coordinate and width dimension; forming the assembly to its parabolic configuration; and bonding the formed assembly to a parabolic reflector dish. As noted earlier, the width dimension $w$ of the strips is determined by the focal length F, and should be on the order of ten percent of the focal length or less. The $y_o$ and end point coordinates of the strips and grid elements may be determined in various ways. This determination may be accomplished, for example, by generating a plane figure conforming to the projection of the parabolic dish onto a plane normal to its principle axis, dividing the figure into increments corresponding to the projections of the liner segments and grid elements onto the plane, determining from the figure the coordinates of the intersections of the perimeter of this figure by the increment sides or boundary edges, and the $y_o$ coordinate of the edges.

It will be obvious to those versed in the art that while the invention has been described in connection with making a polarizing grid liner for a parabolic dish antenna, the same technique may be utilized to form from sheet material a parabolic shell or dish configuration for other purposes. Also, while the described liner or dish is circular in outline, the invention may be utilized to form parabolic liners or dishes of any other perimetrical shape or outline.

We claim:

1. The method of constructing a parabolic dish of focal length F and comprising narrow segments disposed side by side whose projection onto a plane normal to the principle axis of the dish and containing $x$ and $y$ coordinate axes intersecting at an origin on the principle axis is a plane figure divided into narrow increments parallel to the $x$-axis and spaced along the $y$-axis and each having a side adjacent and parallel to the $x$-axis which intersects the $y$-axis at an axis intersection point and terminates in end points on the perimeter of the figure, said method comprising the steps of:

forming from relatively thin flexible sheet material an assembly of curved strips corresponding to said increments, respectively, and arranged side by side in the same order as said increments and each strip having a convex edge and an opposite concave edge, the convex edge of each strip conforming to a curve passing through said axis intersection point of said adjacent side of the corresponding increment and defined by the locus of points expressed by the parametric equations:

$$x = x_o + \frac{1/24F^2}{\left[1 + \left(\frac{y_o}{2F}\right)^2\right]} x_o^3 - \frac{1/640F^4}{\left[1 + \left(\frac{y_o}{2F}\right)^2\right]^2} x_o^5 + \ldots$$

$$y = \frac{y_o/8F^2}{\left[1 + \left(\frac{y_o}{2F}\right)^2\right]} \cdot x_o^2$$

where: $x_o$ is any $x$ coordinate value between and including the $x$ coordinates of the end points of the adjacent side of the corresponding increment, $y_o$ is the $y$ coordinate of the axis intersection point of the adjacent side of the corresponding increment, and the spacing $w$ between said convex and concave edges of each strip parallel to said $y$-axis is uniform and equal to $$w = \sqrt{1 + \left(\frac{y_o}{2F}\right)^2}\, w'$$

where: $w'$ is the width parallel to the $y$-axis of the corresponding increment;

deforming said strips transverse to the plane of the strips to bring their adjacent convex and concave edges into contiguous relation wherein the strips conform to a parabolic curvature; and joining the contiguous strip edges.

2. The method of constructing a parabolic dish of focal length F comprising the steps of:

generating a plane figure conforming to the projection of said dish onto a plane normal to the principle axis of the dish;

establishing in said plane figure $x$ and $y$ coordinate axes intersecting at an origin located at the position of the principle axis;

dividing said plane figure into narrow increments parallel to the $x$-axis and spaced along the $y$-axis and each having a side adjacent and parallel to the $x$-axis which intersects the $y$-axis at an axis intersection point and terminates in end points on the perimeter of the figure;

forming from relatively thin flexible sheet material an assembly of curved strips corresponding to said increments, respectively, and arranged side by side in the same order as said increments and each strip having a convex edge and an opposite concave edge, the convex edge of each strip conforming to a curve passing through said axis intersection point of said adjacent side of the corresponding increment and defined by the locus of points expressed by the parametric equations:

$$x = x_o + \frac{1/24F^2}{\left[1 + \left(\frac{y_o}{2F}\right)^2\right]} x_o^3 - \frac{1/640F^4}{\left[1 + \left(\frac{y_o}{2F}\right)^2\right]^2} x_o^5 +$$

$$y = \frac{y_o/8F^2}{\left[1 + \left(\frac{y_o}{2F}\right)^2\right]} \cdot x_o^2$$

where: $x_o$ is any $x$ coordinate value between and including the $x$ coordinates of the end points of the adjacent side of the corresponding increment, $y_o$ is the $y$ coordinate of the axes intersection point of the adjacent side of the corresponding increment, and the spacing $w$ between said convex and concave edges of each strip parallel to said $y$ -axis is uniform and equal to $$w = \sqrt{1 + \left(\frac{y_o}{2F}\right)^2}\, w'$$

where: $w'$ is the width parallel to the $y$-axis of the corresponding increment;

deforming said strips transverse to the plane of the strips to bring their adjacent convex and concave edges into contiguous relation wherein the strips conform to a parabolic curvature; and joining the contiguous strip edges.

3. The method of claim 2 wherein:

the width of said strips is equal to or less than about one-tenth of the dish focal length.

4. The method of constructing a polarizing parabolic dish antenna reflector comprising the steps of:

forming a parabolic dish of focal length F;

generating a plane of figure conforming to the projection of said dish onto a plane normal to the principle axis of the dish;

establishing in said plane figure $x$ and $y$ coordinate axes intersecting at an origin located at the position of the principle axis;

dividing said plane figure into narrow increments parallel to the $x$-axis and spaced along the $y$-axis and each having a side adjacent and parallel to the $x$-axis which intersects the $y$-axis at an axis intersection point and terminates in end points on the perimeter of the figure;

photoetching a sheet of relatively thin flexible material to define on the sheet a plurality of curved strips corresponding to said increments, respectively, and arranged side by side in the same order as said increments and each having a convex edge, an opposite concave edge, and a plurality of spaced electrically conductive polarized grid lines conforming substantially in curvature extending lengthwise of the strip in substantially parallel relation to said convex edge, the convex edge of each strip conforming to a curve passing through said axis intersection point of said adjacent side of the corresponding increment and defined by the locus of points expressed by the parametric equations:

$$x = x_o + \frac{1/24F^2}{\left[1 + \left(\frac{y_o}{2F}\right)^2\right]} x_o^3 - \frac{1/640F^4}{\left[1 + \left(\frac{y_o}{2F}\right)^2\right]^2} x_o^5 +$$

$$y = \frac{y_o/8F^2}{\left[1 + \left(\frac{y_o}{2F}\right)^2\right]} \cdot x_o^2$$

where: $x_o$ is any $x$ coordinate value between and including the $x$ coordinates of the end points of the adjacent side of the corresponding increment, $y_o$ is the $y$ coordinate of the axis intersection point of the adjacent side of the corresponding increment, and the spacing $w$ between said convex and concave edges of each strip parallel to said $y$-axis is uniform and equal to $$w = \sqrt{1 + \left(\frac{y_o}{2F}\right)^2} \cdot w'$$

where: $w'$ is the width parallel to the $y$ -axis of the corresponding increment;

cutting said sheet along said strip edges to provide a strip assembly; and deforming said strip assembly into conformity with and bonding said strip assembly to the parabolic surface of said dish.

5. Means for forming a parabolic dish of focal length F and comprising narrow segments disposed side by side whose projection onto a plane normal to the principle axis of the dish and containing $x$ and $y$ coordinate axes intersecting at an origin on the principle axis is a plane figure divided into narrow increments parallel to the $x$-axis and spaced along the $y$-axis and each having a side adjacent and parallel to the $x$-axis which intersects the $y$-axis at an axis intersection point and terminates in end points on the perimeter of the figure, said means comprising:

an assembly of curved strips of relatively thin flexible sheet material corresponding to said increments, respectively, and arranged side by side in the same order as said increments and each strip having a convex edge and an opposite concave edge, the convex edge of each strip conforming to a curve passing through said axis intersection point of said adjacent side of the corresponding increment and defined by the locus of points expressed by the parametric equations:

$$x = x_o + \frac{1/24F^2}{\left[1+\left(\frac{y_o}{2F}\right)^2\right]} x_o^3 - \frac{1/640F^4}{\left[1+\left(\frac{y_o}{2F}\right)^2\right]^2} x_o^5 +$$

$$y = \frac{y_o/8F^2}{\left[1+\left(\frac{y_o}{2F}\right)^2\right]} \cdot x_o^2$$

where: $x_o$ is any $x$ coordinate value between and including the $x$ coordinates of the end points of the adjacent side of the corresponding increment, $y_o$ is the $y$ coordinate of the axis intersection point of the adjacent side of the corresponding increment, and the spacing $w$ between said convex and concave edges of each strip parallel to said $y$-axis is uniform and equal to $$w = \sqrt{1+\left(\frac{y_o}{2F}\right)^2}\, w'$$

where: $w'$ is the width parallel to the $y$-axis of the corresponding increment.

6. The subject matter of claim 5 wherein:

said dish is a polarizing parabolic antenna reflector; and each strip includes a plurality of spaced electrically conductive polarizing grid lines conforming substantially in curvature to and extending lengthwise of the strip in parallel relation to the convex strip edge.

7. A polarizing parabolic dish antenna reflector comprising:

a parabolic dish having a concave parabolic surface of focal length F; and an electromagnetic polarizing grid bonded to said surface and comprising narrow segments disposed side by side whose projection onto a plane normal to the principle axis of the dish and containing $x$ and $y$ coordinates axes intersecting at an origin on the principle axis is a plane figure divided into narrow increments parallel to the $x$-axis and spaced along the $y$-axis and each having a side adjacent and parallel to the $x$-axis which intersects the $y$-axis at an axis intersection point and terminates in end points on the perimeter of the figure; and electrically conductive polarizing grid lines on said segments parallel to said sides thereof, said grid comprising an assembly of curved strips of relatively thin flexible sheet material forming said segments, respectively, and having a flat development in which each strip has a convex edge and an opposite concave edge, the convex edge of each strip conforming to a curve passing through said axis intersection point of said adjacent side of the corresponding increment and defined by the locus of points expressed by the parametric equations:

$$x = x_o + \frac{1/24F^2}{\left[1+\frac{y_o}{2F}^2\right]} x_o^3 - \frac{1/640F^4}{\left[1+\frac{y_o}{2F}^2\right]^2} x_o^5 +$$

$$y = \frac{y_o/8F^2}{\left[1+\frac{y_o}{2F}^2\right]} \cdot x_o^2$$

where: $x_o$ is any $x$ coordinate value between and including the $x$ coordinates of the end points of the adjacent side of the corresponding increment, $y_o$ is the $y$ coordinate of the axis intersection point of the adjacent side of the corresponding increment, and the spacing $w$ between said convex and concave edges of each strip parallel to said $y$-axis is uniform and equal to $$w = \sqrt{1+\frac{y_o}{2F}^2}\, w'$$

where: $w'$ is the width parallel to the $y$-axis of the corresponding increment.

* * * * *

UNITED STATES PATENT OFFICE

CERTIFICATE OF CORRECTION

PATENT NO. : 4,001,836
DATED : January 4, 1977
INVENTOR(S) : John S. Archer et al It is certified that error appears in the above-identified patent and that said Letters Patent are hereby corrected as shown below:

Column 5, line 28, change "FIG. i" to --FIG. 8--

Column 5, line 30, change "field" to --full--

Column 5, line 35, in equation, change "du" to --dy--

Column 5, line 35, at the end of the line, number equation --(1)--

Column 5, line 54, change "x" to --y--

Column 5, line 55, change "y plane" to --z plane--

Column 5, line 65, change "z-y' " to --z,y'--

Column 6, line 3, at the end of the line, number equation --(2)--

Column 6, line 53, change "$y_2$" to --$x_2$--

Column 6, line 65, change "32" to --30--

Column 6, line 68, change "x'" to --y'--

Column 7, line 7, change "y" to --x--

UNITED STATES PATENT OFFICE

CERTIFICATE OF CORRECTION

Patent No. 4,001,836 Dated January 4, 1977

Inventor(s) John S. Archer et al.

It is certified that error appears in the above-identified patent and that said Letters Patent are hereby corrected as shown below:

Column 10, line 29, after "curvature" insert -- to and --.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 4,001,836

DATED : January 4, 1977

INVENTOR(S) : John S. Archer et al.

It is certified that error appears in the above-identified patent and that said Letters Patent are hereby corrected as shown below:

Column 1, line 56 after "beam" --two-- should be inserted. "transmission" should be deleted and --transmissions-- inserted therefor.

Column 2, line 18 the comma (,) after "another" should be deleted.

Column 6, line 2 of the equation (3) after "+" --...-- should be added.

line 3 of equation (3) after "+" --...-- should be added.

Claim 2, line 1 of the equation after the last "+" at the end --...-- should be added, Claim 4, line 1 of the equation after the last "+" at the end --...-- should be added.

Claim 5, line 1 of the equation after the last "+" at the end --...-- should be added.

UNITED STATES PATENT AND TRADEMARK OFFICE

CERTIFICATE OF CORRECTION

PATENT NO. : 4,001,836

DATED : January 4, 1977

INVENTOR(S) : John S. Archer et al.

It is certified that error appears in the above-identified patent and that said Letters Patent are hereby corrected as shown below:

Column 5, lines 66-67 "developes" should be deleted and --develops-- substituted therefor.

Claim 7, lines 30-38 delete the equations $$x = x_o + \frac{1/24F^2}{\left[1 + \frac{Y_o}{2F}^{2}\right]} x_o^3 - \frac{1/640F^4}{\left[1 + \frac{Y_o}{2F}^{2}\right]} x_o^5 +$$

$$Y = \frac{Y_o/8F^2}{\left[1 + \frac{Y_o}{2F}^{2}\right]} \cdot x_o^2$$

and substitute

UNITED STATES PATENT AND TRADEMARK OFFICE

CERTIFICATE OF CORRECTION

PATENT NO. : 4,001,836

DATED : January 4, 1977

INVENTOR(S) : John S. Archer et al.

It is certified that error appears in the above-identified patent and that said Letters Patent are hereby corrected as shown below:

the following equations therefor.

$$x = x_o + \frac{1/24F^2}{\left[1 + \left(\frac{Y_o}{2F}\right)^2\right]} x_o^3 - \frac{1/640F^4}{\left[1 + \left(\frac{Y_o}{2F}\right)^2\right]^2} x_o^5 + \ldots$$

$$Y = \frac{Y_o/8F^2}{\left[1 + \left(\frac{Y_o}{2F}\right)^2\right]} \cdot x_o^2$$

Claim 7, lines 47-49 delete the equation $$w = \sqrt{1 + \frac{Y_o}{2F}^2}\ w' \quad \text{and insert} \quad w = \sqrt{1 + \left(\frac{Y_o}{2F}\right)^2}\ w'$$

therefor.

UNITED STATES PATENT AND TRADEMARK OFFICE

CERTIFICATE OF CORRECTION

PATENT NO. : 4,001,836

DATED : January 4, 1977

INVENTOR(S) : John S. Archer et al.

It is certified that error appears in the above-identified patent and that said Letters Patent are hereby corrected as shown below:

In the drawings:

Figure 7, change numeral "34" to --36-- at beginning of drawing and add numeral --34-- as shown below:

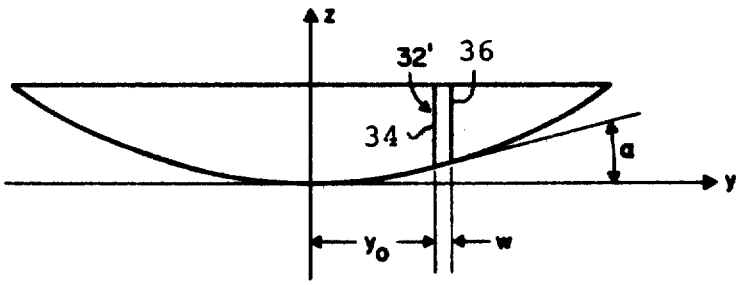

Fig. 7

UNITED STATES PATENT AND TRADEMARK OFFICE

CERTIFICATE OF CORRECTION

PATENT NO. : 4,001,836

DATED : January 4, 1977

INVENTOR(S) : John S. Archer et al.

It is certified that error appears in the above-identified patent and that said Letters Patent are hereby corrected as shown below:

Figure 8, add numeral --36-- and a lead line for numeral 44 as shown below:

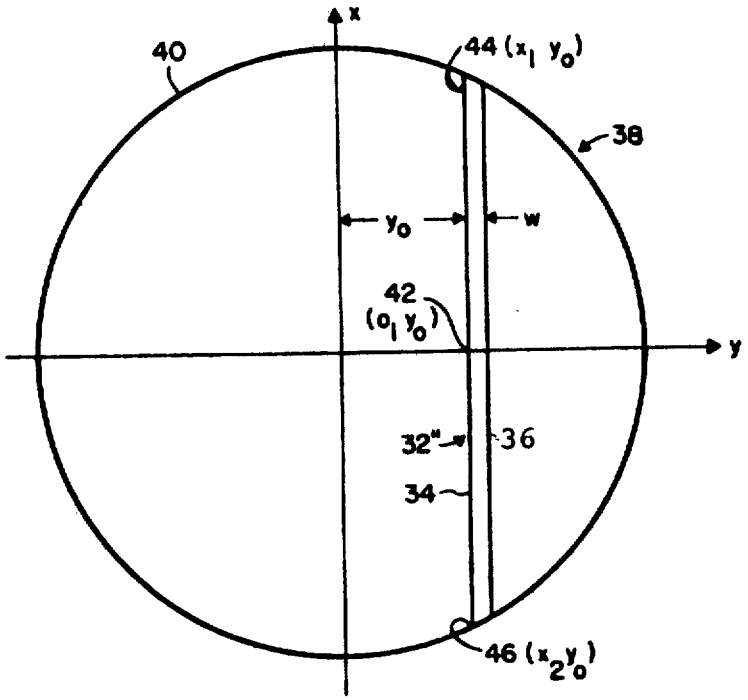

Fig. 8

UNITED STATES PATENT AND TRADEMARK OFFICE

CERTIFICATE OF CORRECTION

PATENT NO. : 4,001,836 Page 6 of 7

DATED : January 4, 1977

INVENTOR(S) : John S. Archer et al.

It is certified that error appears in the above-identified patent and that said Letters Patent are hereby corrected as shown below:

Figure 9, add numerals 32', 34 and 36, reference w, and z' axis as shown below:

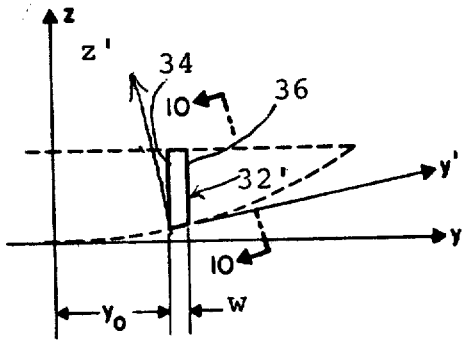

Fig. 9

Figure 10, add reference numeral --32'--, lead lines for the reference characters p and p' and delete the axis reference x, as shown below:

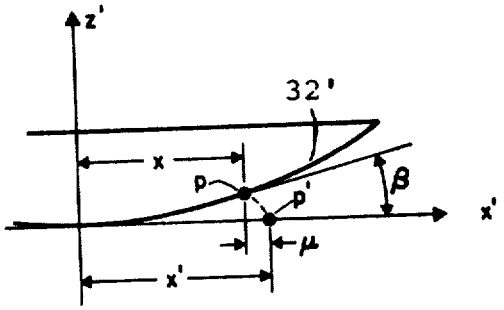

Fig. 10

UNITED STATES PATENT AND TRADEMARK OFFICE

CERTIFICATE OF CORRECTION

PATENT NO. : 4,001,836

DATED : January 4, 1977

INVENTOR(S) : John S. Archer et al.

Figure 11:
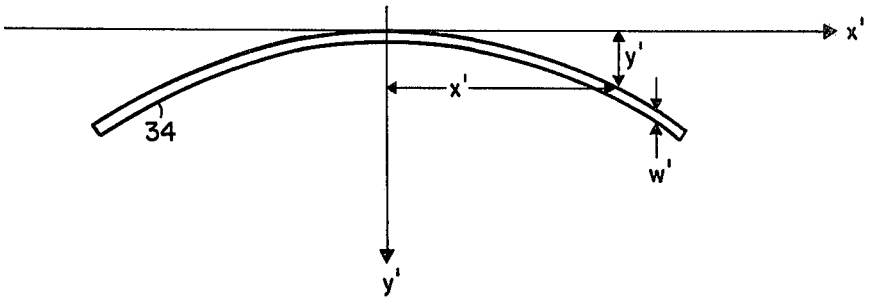

It is certified that error appears in the above-identified patent and that said Letters Patent are hereby corrected as shown below:

Figure 11, delete reference numeral "34" and add reference numerals --32 and 34'-- as shown below:

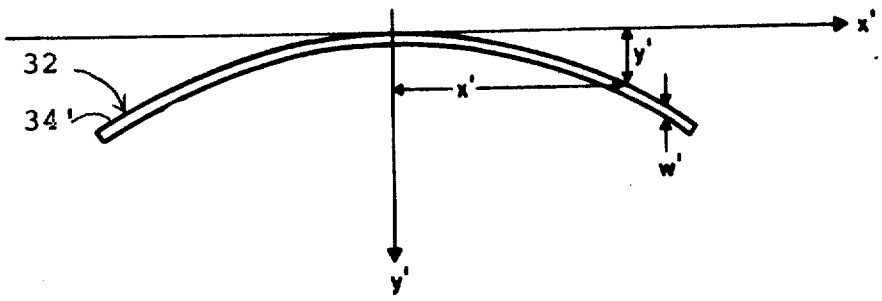

*Fig. 11*

Signed and Sealed this

*Twenty-first* Day of *February 1984*

[SEAL]

*Attest:*

GERALD J. MOSSINGHOFF

*Attesting Officer*

*Commissioner of Patents and Trademarks*